United States Patent [19]

Iskander

[11] Patent Number: 4,510,437

[45] Date of Patent: Apr. 9, 1985

[54] APPARATUS AND METHOD FOR MEASURING THE PERMITTIVITY OF A SUBSTANCE

[75] Inventor: Magdy F. Iskander, Salt Lake City, Utah

[73] Assignee: University of Utah, Salt Lake City, Utah

[21] Appl. No.: 518,532

[22] Filed: Jul. 29, 1983

Related U.S. Application Data

[62] Division of Ser. No. 194,153, Oct. 6, 1980, Pat. No. 4,396,062.

[51] Int. Cl.[3] ..... G01R 27/26

[52] U.S. Cl. ..... 324/61 R; 324/58.5 A; 324/58.5 B

[58] Field of Search ..... 324/61 P, 61 R, 58.5 A, 324/58.5 B; 73/61 R

[56] References Cited

U.S. PATENT DOCUMENTS

| | | | |
|---|---|---|---|
| 3,233,172 | 2/1966 | Luoma | 324/58.5 B |
| 3,364,421 | 1/1968 | Bullwinkel | 324/58.5 B |
| 3,437,924 | 4/1969 | Tocanne | 324/61 P |
| 3,562,642 | 2/1971 | Hochschild | 324/58.5 B |
| 3,826,980 | 7/1974 | Deichelmann | 324/61 P |
| 3,965,416 | 6/1976 | Friedman | 324/58.5 B |
| 4,135,579 | 1/1979 | Rowland et al. | 166/248 |
| 4,140,180 | 2/1979 | Bridges et al. | 166/248 |
| 4,265,307 | 5/1981 | Elkins | 166/248 |
| 4,266,195 | 5/1981 | Keefner | 324/61 P X |

FOREIGN PATENT DOCUMENTS

| | | | |
|---|---|---|---|
| 981751 | 1/1976 | Canada | 324/58.5 B |
| 2427031 | 12/1975 | Fed. Rep. of Germany | 166/248 |

OTHER PUBLICATIONS

Judzis, Arvida, Jr., *Assaying Green River Oil Shale With Microwave Radiation,* Ph.D. Dissertation, University of Michigan, (Ann Arbor, Michigan, 1978).

Bridges, J. E., Allen Taflove, and R. H. Snow, *Net Energy Recoveries for the In Situ Dielectric Heating of Oil Shale,* IIT Research Institute, 10 West 35th Street, Chicago, Illinois, (1978).

Snow, R. H., J. E. Bridges, S. K. Goyal, and A. Taflove, *Comparison of Dielectric Heating and Pyrolysis of Eastern and Western Oil Shales,* IIT Research Institute, 10 West 35th Street, Chicago, Illinois, (1980).

Nicolson et al., "The Measurement of the Intrinsic Properties of Materials by Time-Domain Techniques", CPEM Digest, Conference on Precision Electromagnetic Measurements, Boulder, Colo., (Jun. 2-5, 1970), pp. 63, 65.

Iskander, M. F. & Stuchly, S. S., "A Time-Domain Technique for Measurement of the Dielectric Properties of Biological Substances," IEEE Transactions on Instrumentation and Measurement, vol. IM-21, No. 4, pp. 425-429, (Nov. 1972).

Stuchly, S. S., Rzepecka, M. A. & Iskander, M. F., "Permittivity Measurements at Microwave Frequencies Using Lumped Elements," IEEE Transactions on Instrumentation and Measurement, vol. IM-23, No. 1, pp. 56-62, (Mar. 1974).

(List continued on next page.)

[57] ABSTRACT

A novel apparatus and method for time-domain tracking of high-speed chemical reactions. The apparatus of the present invention includes an RF heating system for heating a reaction zone and a probe system in the reaction zone for measuring the complex permittivity in the reaction volume. A feedback system controls the RF source by adjusting the frequency of the RF source as a function of the relaxation frequency as determined by the permittivity measured by the probe system. Advantageously, the novel apparatus and method of this invention is particularly useful for RF dielectric heating to recover products from oil shales since it was found that the optimum RF frequency for heating oil shale changes rapidly as the kerogen is heated to elevated temperatures.

29 Claims, 13 Drawing Figures

APPARATUS AND METHOD FOR MEASURING THE PERMITTIVITY OF A SUBSTANCE

RELATED APPLICATIONS

This application is a divisional application of the copending application Ser. No. 06/194,153, filed Oct. 6, 1980 for APPARATUS AND METHOD FOR TIME-DOMAIN TRACKING OF HIGH-SPEED CHEMICAL REACTIONS, now issued as U.S. Pat. No. 4,396,062.

BACKGROUND

THE FIELD OF THE INVENTION

This invention relates to measuring probes and, more particularly, to a novel apparatus and method for measuring the permittivity of a substance so as to enable the accurate time-domain tracking of high-speed chemical reactions, and specifically to enable the time-domain tracking of thermal processing of oil shale using microwave heating of the oil shale.

THE PRIOR ART

The quantity of oil shale in the world represents a very large energy resource. One estimate states that there is a total resource of oil shale in the United States of about 2.2 trillion barrels of which about 80 billion barrels are considered as recoverable reserves using existing technology. As with other energy sources, however, the estimates of the magnitude vary widely.

The term "oil shale", although a misnomer, is a term used to refer to a marlstone deposit interspersed with inclusions of a solid, coal-like organic or hydrocarbon polymer referred to as "kerogen". Kerogen is a macromolecular material having a molecular weight greater than 3,000 with an empirical formula approximating $C_{200}H_{300}SN_5O_{11}$. The composition of the organic material from oil shale taken from the Mahogany zone of Colorado revealed a carbon content of approximately 80.5 percent by weight, with 10.3 percent hydrogen, 2.4 percent nitrogen, 1.0 percent sulfur, and 5.8 percent oxygen, for a carbon/hydrogen ratio of about 7.8. It should be noted that the carbon/hydrogen ratio for petroleum ranges between 6.2 and 7.5.

Kerogen predominantly has a linearly condensed, saturated cyclic structure with heteroatoms of oxygen, nitrogen, and sulfur with straight-chain and aromatic structures forming a minor part of the total kerogen structure. Synthetic liquid and gaseous products that have some similarities to oil or oil products can be extracted from the kerogen, although the products are not a true oil product. Different solvents and different degradation temperatures yield products with different compositions.

Over the years, various in situ processes have been suggested to recover useful fuels from oil shale deposits. These processes generally involve conventional thermal processes which require development of a thermal gradient; that is, the outside of the shell block being maintained at a higher temperature than the inner portion. However, large thermal gradients represent an inefficient use of the applied thermal energy, and can also lead to a degraded shale oil product having a very high pour point.

When oil shale is heated to about 430°–480° C., the kerogen decomposes to form oil, gas, bitumen, and a carbonaceous residue which is retained on the spent shale. The bitumen decomposes further to form oil, gas, and additional residual carbon. Because of the very complex nature of kerogen, various reaction mechanisms have been proposed. However, the reaction has generally been treated as though it were first order with respect to the concentration of kerogen in the formation of bitumen and also first order with respect to bitumen decomposition in the subsequent formation of oil and gas. While the resultant oil and gas product migrates to the surface of the shale and is swept away, the residual carbon remains on the spent shale.

Residual carbon is an energy source that can be utilized by conventional combustion techniques to provide thermal energy for the process. In situ combustion of this residual carbon for the production of products from oil shale involves the regulated introduction of oxygen into a previously rubbilized oil shale formation for the purpose of controlling combustion of the residual carbon. However, when the size of the oil shale formation is sufficiently large, as in most in situ retorting processes, the residual carbon or char is not completely burned, thus necessitating combustion of a portion of the product oil vapor to supplement the required thermal energy. Additionally, direct combustion of carbonaceous residue takes place in proximity to the zone where the oil vapor is being produced, thereby increasing the probability that oxygen will reach the latter zone and oxidize a portion of the oil vapor. This problem is more severe in in situ combustion retorting processes in which oil shale blocks of wide size distribution are retorted.

The flow of gases in large oil shale blocks is much more nonuniform which, in turn, increases the infiltration of oxygen into the zone of oil vapor production. Furthermore, it has also been found that an attempt to increase the retorting rate is generally accompanied by a corresponding increase in the combustion rate of the oil vapor thereby further lowering the product recovery ratio.

Another traditional approach for extracting kerogen or, more precisely, products therefrom, from oil shale is to heat the oil shale in an above-ground retort. The oil shale is mined and then processed by size reduction for ease of handling and good thermal (gas/solid) transfer. While the extraction of kerogen from the inorganic, mineral matrix is highly efficient in an above-ground process, an underground mining operation leaves about 35 percent of the oil shale in place for structural support in the mine. Furthermore, a mining operation followed by an above-ground thermal processing is economically viable only with the very high grade oil shale materials (generally greater than about 25 gallons per ton).

The use of radio frequency (RF) dielectric heating represents a new and alternative technology to recover useful fuels from oil shale and other hydrocarbonaceous deposits. By this method, large blocks of oil shale can be heated from within to a uniform temperature. This heating is independent of the thermal conductivity and gas permeability of the raw oil shale. Additionally, RF heating can result in a nearly true in situ process because only one to three percent of the oil shale is removed to place electrodes, thereby allowing a large percentage of the deposit to be processed. Environmental problems are also minimized (1) by leaving the spent shale in place and (2) by avoiding in-place combustion. One useful publication relating to the dielectric heating of oil shales is *Comparison of Dielectric Heating and Pyrolysis of Eastern and Western Oil Shales,* R. H. Snow, J. E.

Bridges, S. K. Goyal, and A. Taflove, IIT Research Institute, 10 West 35th Street, Chicago, Ill. 60616.

However, another study found that the amount of RF energy absorbed by the oil shale was so small that reflected energy was nearly the same as the incident energy. Additionally, it was found that the results were both void-fraction-dependent and frequency-dependent. The ultimate conclusion from this later study was that the frequency dependence was not regarded as having practical significance since development reactors will most likely be designed around a battery of cheap and available 2450 MHz magnetron tubes, the kind of tube used in the study. The conclusion drawn from this latter study was that the most relevant outcome was the discovery that oil shales vary in unexpected ways in their RF absorption characteristics. It was therefore assumed that if an RF processing technique should prove to be worthy of development, very careful analysis of the oil shales would be necessary. See *Study of the Chemical Values of Oil Shale Through Rapid Pyrolysis,* N. W. Ryan, pg. 187 of *Final Report on Selected Research Projects Leading to the Development of Utah Coal, Tar Sands, and Oil Shale,* College of Mines and Mineral Industries, College of Engineering, and the Utah Engineering Experiment Station, October 1978.

However, it is also important to note that the careful analysis of oil shales during rapid heating is extremely complicated since the chemical changes occurring during rapid heating are extremely fast or even abrupt, thus prohibiting a careful analysis of these changes using conventional techniques.

In view of the foregoing, it would be a significant advancement in the art to provide a novel apparatus and method for tracking high-speed chemical reactions. It would also be an advancement in the art to provide a novel apparatus and method for tracking the high-speed or abrupt thermal decomposition of kerogen in oil shales upon heating by RF dielectric heating. It would also be an advancement in the art to provide a novel apparatus and method for tracking changes in the permittivity of oil shales. It would also be an advancement in the art to provide a novel process for heating kerogen in oil shale using RF dielectric heating while maintaining the optimum RF frequency for heating. Another advancement in the art would be to provide a feedback system to adjust the frequency of the RF radiation to consistently correspond to the relaxation frequency required for optimum RF heating. Such a novel apparatus and method is disclosed and claimed herein.

BRIEF SUMMARY AND OBJECTS OF THE INVENTION

The present invention relates to a novel apparatus and method for time-domain tracking of high-speed chemical reactions. The apparatus of the present invention includes an RF heating system for heating a reaction zone and a probe system in the reaction zone for measuring the complex permittivity in the reaction volume. A feedback system controls the RF source by adjusting the frequency of the RF source as a function of the relaxation frequency as determined by the permittivity measured by the probe system. Advantageously, the novel apparatus and method of this invention is particularly useful for RF dielectric heating to recover products from oil shales since it was found that the optimum RF frequency for heating oil shale changes rapidly as the kerogen is heated to elevated temperatures.

It is, therefore, a primary object of this invention to provide improvements in apparatus for time-domain tracking of high-speed chemical reactions.

It is another object of this invention to provide improvements in the method for time-domain tracking of high-speed chemical reactions.

Another object of this invention is to provide an apparatus for tracking changes in the permittivity of oil shale during heating.

Another object of this invention is to provide a feedback system which utilizes the information obtained from the permittivity measurement of oil shale, and, in particular, the relaxation frequency to control the RF energy source to the reaction zone.

Another object of this invention is to provide an improved RF processing system for oil shale having an adjustable heating condition by adjusting the RF frequency to achieve optimum or most efficient heating at the relaxation frequency.

These and other objects and features of the present invention will become more fully apparent from the following description and appended claims, taken in conjunction with the accompanying drawings.

DETAILED DESCRIPTION OF THE PREFERRED EMBODIMENTS

Figure 1A:
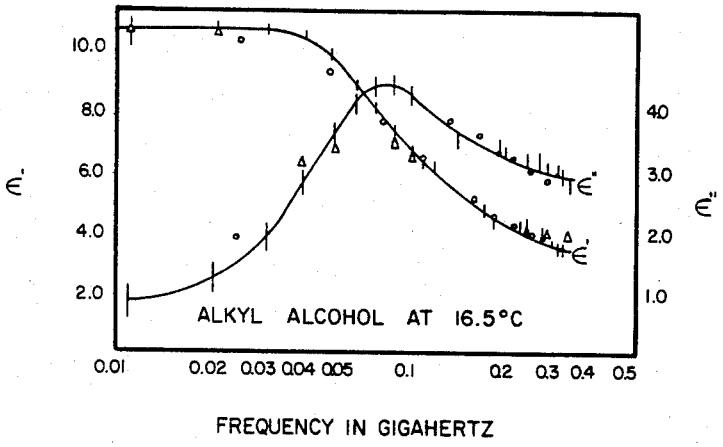
FIGS. 1*a* and 1*b* represent experimental results obtained using alkyl alcohol at 16.5° C. and 25° C., respectively.

The invention is best understood by reference to the drawings wherein like parts are designated with like numerals throughout.

General Discussion

The design of optimal processes for recovery of liquid and gaseous fuels from oil shale depends, critically, on an understanding of the manner in which kerogen decomposes to form bitumens, and then to oils and gases under a variety of process conditions. For materials which undergo thermal decomposition or a phase transformation such as oil shales, it is necessary to characterize their thermal behavior by thermo analytical techniques such as differential thermal analysis and thermogravimetry. Measurement of the electrical properties has become an integral part of thermophysical characterization in view of their extreme sensitivity to changes occurring in the material during heating.

The prior art, frequency-domain procedure used to measure the real and imaginary parts of the complex permittivity $\epsilon^*$ depends principally on the frequency band of interest. In general, the measurement procedure involves placing the substance between the two plates of a capacitor (at low frequency) or in a coaxial line and measuring the complex impedance at different frequencies. A number of measurements over a wide frequency range are required for complete characterization. This process is time consuming and demands a considerable investment in instrumentation, particularly in the microwave region. The adequacy of these point-by-point frequency domain measurements to track fast (or abrupt) chemical changes, such as those occurring during rapid heating of oil shale, is therefore severely limited. This is because the time required for the swept frequency dielectric measurements at a particular temperature sets a natural limit for the heating rate that can be employed.

One can obtain the same information over a wide frequency range in only a fraction of a second by making the measurement, not in the frequency domain, but in the time-domain, using a pulse that simultaneously contains all the frequencies of interest. Due to the wide, instantaneous spectrum of the pulse, frequency information can be obtained over several decades by a single measurement of the subnanosecond rise-time response of the system under test by applying Fourier transforms. The availability of modern tunnel diode pulse generators and wide band sampling oscilloscopes make such a procedure suitable for measurements in the microwave region where savings in time and equipment are most pronounced.

This invention relates to a time-domain technique for the measurement of the dielectric properties of oil shale over a broad frequency band. The theory upon which the time-domain technique is based involves the use of a time-domain reflectometer. When a time-domain reflectometer is used, a very fast rise (subnanosecond) voltage step is generated, while both incident and reflected waves picked up by a high-impedance sampler are displayed on the screen of a broad-band sampling oscilloscope. The deflection of the oscilloscope trace is proportional to the algebraic sum of the incident and reflected waves. The striking advantages of this technique include simplicity of the procedure, relatively cheap equipment needed, and of particular interest, the considerably shorter time required to do the measurements.

Experimental Procedure and Results

The experimental set-up of these measurements basically utilizes a time-domain reflectometer connected to a coaxial transmission line section terminated by a small lumped or shunt capacitor. The small shunt capacitor terminating a coaxial line section serves as the sample holder. Since the optimum value of the capacitance is directly related to the frequency band of interest and the dielectric constant of the material under test, the geometrical dimensions of the sample holder are chosen so as to provide a 50 ohm coaxial line terminated by a capacitance in the optimum range. An oil shale sample is placed in the gap of the capacitor sample holder and a reference signal from a short circuit placed at the location of the sample holder. The reflected signals at the sample interface are recorded, digitized, and their Fourier transform is calculated. This procedure determines the frequency dependence of the reflection coefficient, which can then be used to calculate the real and imaginary parts of the relative permittivity. Caution should be exercised in selecting the capacitance of the sample holder so as to provide minimum uncertainties in the results over the desired frequency band.

The feasibility of the procedure was first evaluated by measuring the dielectric properties of a material of known properties such as teflon and alkyl alcohol. The value of the air-filled capacitance was $C_o=2.8$ pF, which is in the optimum capacitance range for this dielectric in the frequency range between 10 MHz and 2 GHz. The obtained results for alkyl alcohol are shown in FIG. 1, where it is clear that they are in good agreement with the available data. The triangular-shaped points represent points obtained by calculations assuming the ideal Debye dispersion with the single relaxation time, while the circular-shaped points represent experimental points. Both results were obtained from frequency-domain measurements.

Additional discussion relating to measurements in the time-domain and to the measurement of the complex permittivity of oil shale may be found in the following publications:

*Permittivity Measurements at Microwave Frequencies Using Lumped Elements,* S. S. Stuchly, N. A. Rzepecka, and M. F. Iskander, IEEE Transactions on Instrumentation and Measurement, vol. IM-23, No. 1, March 1974;

*Automatic Network Measurements in the Time Domain,* J. R. Andrews, Proceedings of the IEEE, vol. 66, No. 4, April 1978;

*Online Measurements of the Fast Changing Dielectic Constant in Oil Shale Due to High-Power Microwave Heating,* ChiaLun J. Hu, IEEE Transactions on Microwave Theory and Techniques, vol. MTT-27, No. 1, January 1979; and

*Fringing Field Effect in the Lumped-Capacitance Method for Permittivity Measurement,* M. F. Iskander and S. S. Stuchly, IEEE Transactions on Instrumentation and Measurement, vol. IM-27, No. 1, March 1978.

Figure 7:
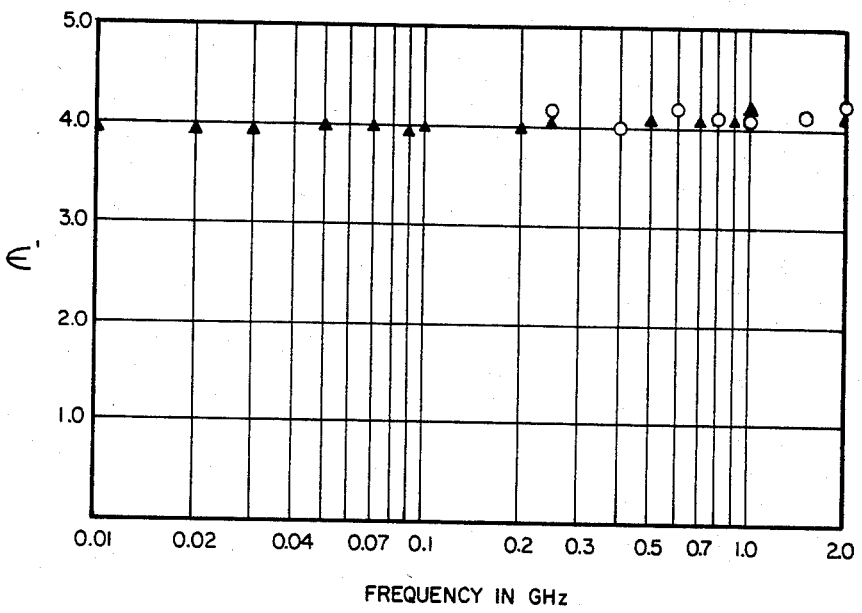
FIG. 7 is a graphical representation of the dielectric constant of oil shale as a function of frequency at 25° C.

Referring now more particularly to FIG. 7, the experimental results obtained using oil shale are shown. More precisely, the dielectric constant (the real part of the permittivity, $\epsilon'$) for oil shale is plotted as a function of frequency at 25° C. The triangular points represent experimental values calculated from time-domain measurements and were obtained from oscilloscope traces such as shown in FIG. 2 after taking Fourier transform. The circular points represent point-by-point frequency domain measurements using a slotted transmission line. Additional discussion regarding the frequency domain measurements using a slotted transmission line may be obtained from *Assaying Green River Oil Shale With Microwave Radiation,* A. Judzis, Jr., Ph.D., Dissertation, University of Michigan, Ann Arbor, Mich., 1978.

A macroscopic description of the dielectric properties of a material is provided by the complex dielectric permittivity:

$$\epsilon^*=\epsilon'-j\epsilon'' \quad (1)$$

The real part $\epsilon'$ is related to the mechanism of the dielectric polarization effects which might rise from electronic, ionic, or orientational polarization. The imaginary part, $\epsilon''$, on the other hand, is descriptive of all loss mechanisms in the dielectric at a given frequency. Therefore, the points of maximum values of $\epsilon''$ in the experimental results shown in FIGS. 1*a* and 1*b* correspond to frequencies at which maximum absorption of the RF energy occurs (relaxation frequencies).

Figure 1B:
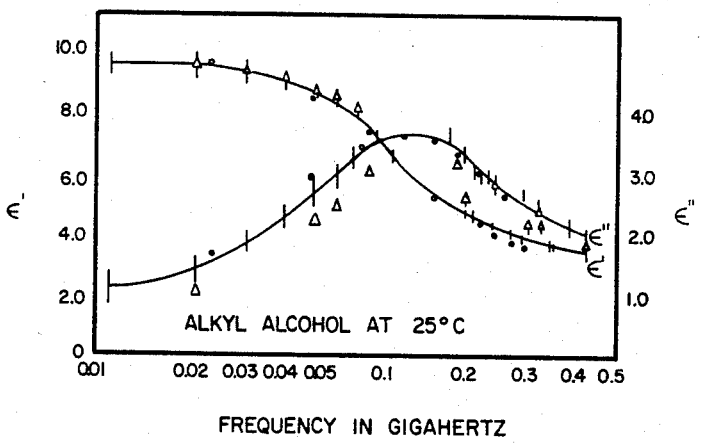
Figure 2A:
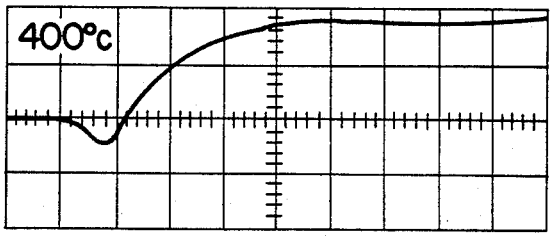
FIGS. 2*a*–2*f* represent actual time-domain reflectometer oscilloscope traces of the reflection coefficient for oil shale samples at various temperatures.
Figure 2B:
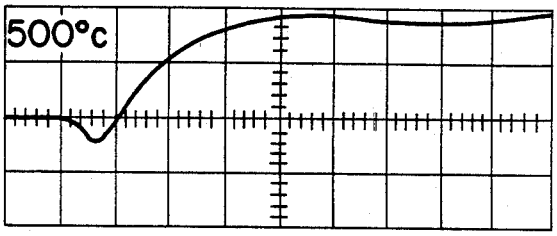
Figure 2C:
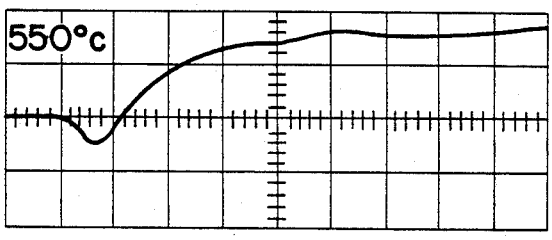
Figure 2D:
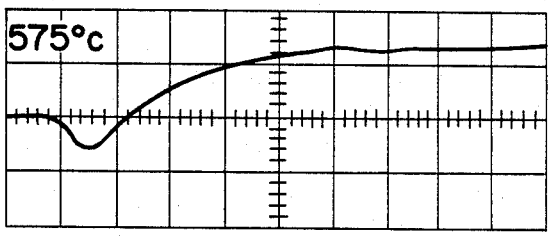
Figure 2E:
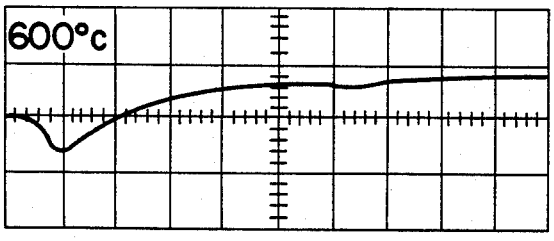
Figure 2F:
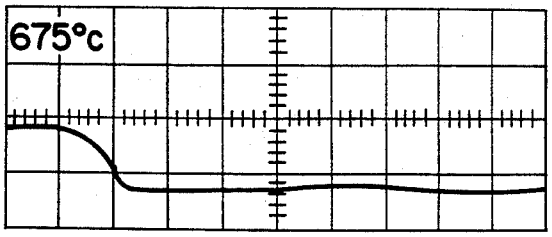

FIGS. 1*a* and 1*b* also illustrate that these relaxation frequencies (points of maximum RF absorption) shift with the temperature variation. These observations are particularly important in RF energy heating of oil shale since the RF frequency should be adjusted to correspond to the value at which maximum absorption occurs (i.e., at the relaxation frequency) to obtain the most efficient processing. The operating frequency should also be changed at various temperatures to continuously track the changes in the relaxation frequency.

Recently, with the increasing interest in measuring the electrical properties of oil shale during retorting, it was quickly recognized that the properties of such material change rapidly with temperature, particularly during the rapid heating, for example, using microwaves. This is exemplified in FIGS. 2*a*–2*f*, wherein the reflection coefficient is represented by oscilloscope tracings at various temperatures. The horizontal axis is marked off in 400 picosecond time divisions. The time-domain technique, therefore, provides a rapid and sensitive means for tracking (at high speed) reactions as they proceed and offers an exciting possibility for developing increased insight into reaction mechanisms.

In addition to the established advantages of the time-domain techniques, which include simplicity of the procedure and relatively cheap equipment, its application in the oil shale industry is particularly attractive and useful by reason of the following:

(1) It provides a complete (measured over a broad frequency band), rapid and sensitive method of tracing reactions as they proceed under varying retorting conditions.

(2) It provides an exciting possibility for designing an optimum oil shale processing procedure particularly using microwave (or radio frequency) heating. For in situ heating using RF energy, the electrical properties can be monitored continuously over a broad frequency band and hence, the heating conditions (e.g., the RF frequency) can be adjusted so as to continuously correspond to the point of maximum absorption (i.e., most efficient heating).

(3) The lumped capacitor used as a sample holder and the possible adjustment of its capacitance so as to provide minimum uncertainties in the results (best accuracy) over the desired frequency band provides a crucial variable that links the high and low frequency dielectric measurement techniques. Since the transmission lines procedures are suitable for high frequency measurements (above 100–200 MHz) while the lumped elements and circuit theory concepts may be used at lower frequencies, the sample holder (shunt capacitor terminating a coaxial line) provides a convenient bridge between the high and low frequency procedures. Importantly, there is no known dielectric constant data for oil shale in the frequency range between one MHz and above 250 MHz, although certain work has been conducted for frequencies below 1 MHz and above 250 MHz. The lumped capacitor method provided experimental results in the frequency range including the band between 10 MHz and 250 MHz.

(4) The time-domain technique should provide rapid and complete (over a broad frequency band) information on the nature of underground formations. In this case, the sample holder will be an open-ended coaxial transmission line with extended center conductor as illustrated in and discussed more fully hereinafter with respect to FIGS. 4–6.

Figure 3:
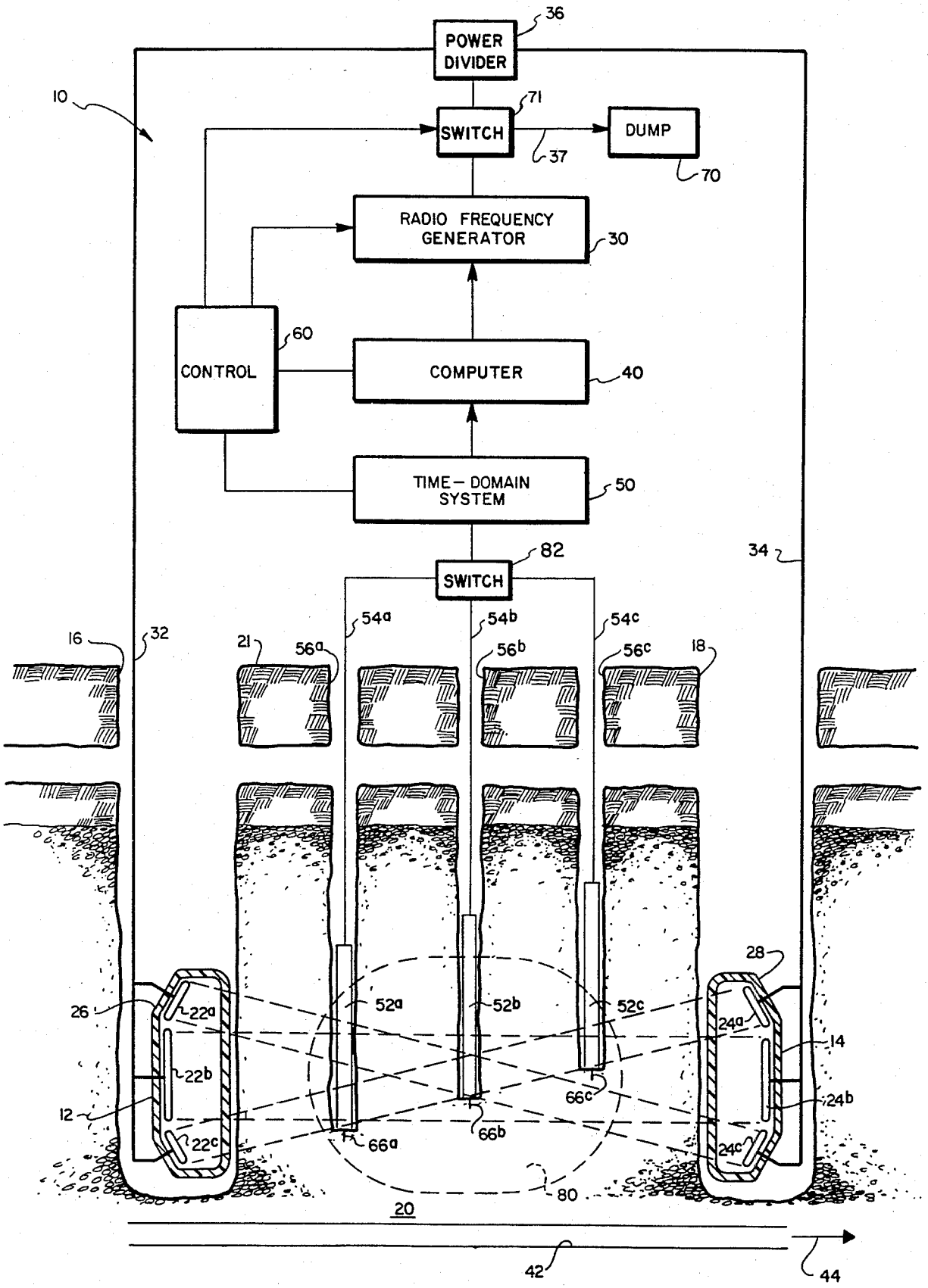
FIG. 3 is a schematic illustration of one presently preferred embodiment for recovering products from oil shale using the novel time-domain tracking of high-speed chemical reactions of this invention.

Referring now more particularly to FIG. 3, one presently preferred embodiment for practicing the present invention in a body of oil shale is shown generally at 10 and includes a plurality of RF radiators 12 and 14 inserted in boreholes 16 and 18, respectively, extending downwardly into a body of oil shale 20. Product 44 is recovered through a product borehole 42 according to conventional techniques. RF radiators 12 and 14 are identical and each respectively includes a plurality of radiators 22*a*–22*c* encased in a housing 26 and radiators 24*a*–24*c* encased in a housing 28. Radiators 22*a*–22*c* and radiators 24*a*–24*c* are respectively focused into a general vicinity of a reaction zone indicated by broken lines at 80. A plurality of probes 52*a*–52*c* are inserted into the oil shale within reaction zone 80 by extending into boreholes 56*a*–56*c*, respectively. A conductor 66*a*–66*c* of each is embedded within the body of oil shale 20, the function of which will be discussed more fully below.

Figure 5:
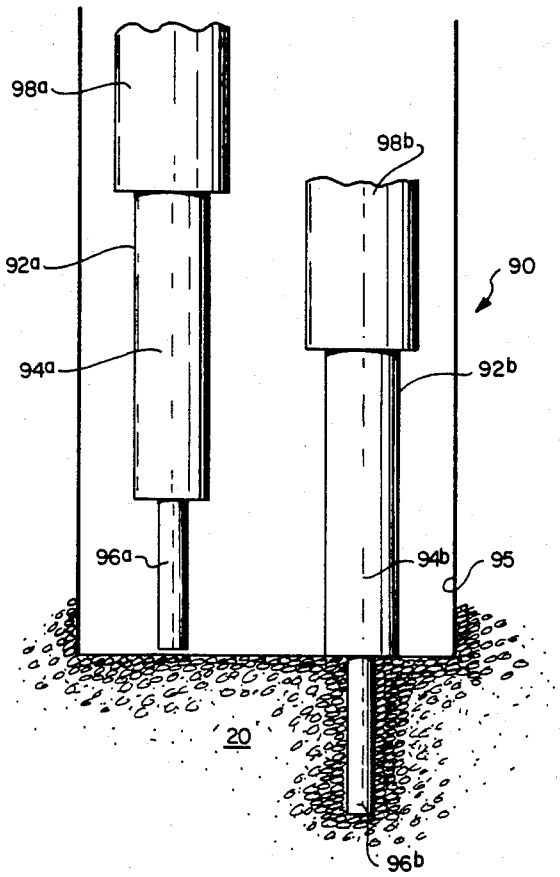
FIG. 5 is an enlarged, elevational view of another preferred embodiment of the probe system of this invention.
Figure 6:
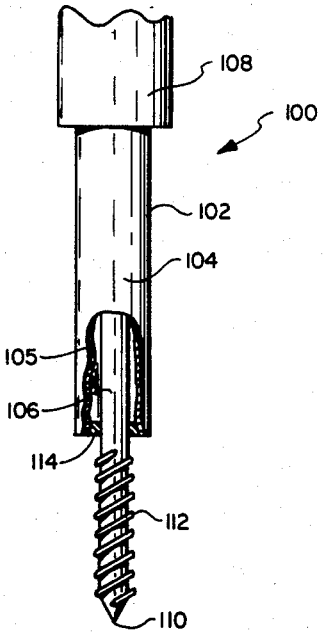
FIG. 6 is an enlarged, elevational view of another preferred embodiment of the measurement probe of this invention with portions broken away to reveal internal construction.

Probes 52*a*–52*c* may comprise virtually any broad band transmission line (that is, a transmission line which is capable of transmitting broad frequency band pulses). For example, probes 52*a*–52*c* could each comprise an open strip transmission line. Importantly, however, as mentioned above, probes 52*a*–52*c* are preferably adjustable such that the capacitance of the probes can be set at an optimal level. Preferred embodiments of such an adjustable probe are depicted in FIGS. 4–6.

Figure 4:
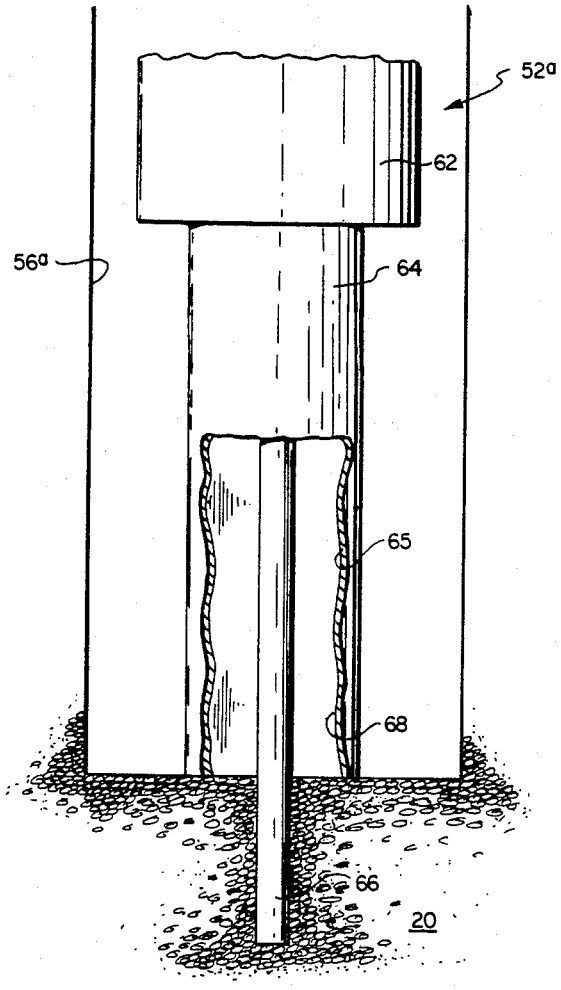
FIG. 4 is an enlarged, elevational view of one presently preferred embodiment of the measurement probe of this invention with portions broken away to reveal internal construction.

Referring now more particularly to FIG. 4, one presently preferred embodiment of probe 52*a* is shown greatly enlarged and with portions broken away to reveal internal construction. As shown, probe 52*a* is fabricated as a cylindrical ground plane conductor 68 having a hollow center and a center conductor 66 coaxially mounted therein forming an open-ended, coaxial transmission line 64. Transmission line 64 is affixed to a coaxial connector 62 on the end of line 54*a* (FIG. 3). The length of center conductor 66 extending beyond the end of ground plane conductor 68 is (a) embedded in oil shale 20 and (b) variable so as to provide minimum uncertainties in the measured results over the desired frequency band. In particular, the length should be longer for measurements at lower frequencies and shorter (or even, possibly, zero) for higher frequencies. The particular length will obviously depend on the dielectric material under test.

This in situ sample holder has measurement advantages similar to those of the lumped capacitor insofar as it provides a link between low and high frequency measurement techniques. In particular, the length of the center conductor extending beyond the end of the ground plane conductor can be adjusted to provide maximum accuracy in the desired frequency range.

Referring again to FIG. 3, RF radiator systems 12 and 14 are interconnected to an RF generator 30 through leads 32 and 34, respectively, the power thereto being selectively predetermined by a power divider 36. Signals developed in probes 52*a*–52*c* are directed by leads 54*a*–54*c* through a switch 82 into the time-domain system 50. The signals received thereby are used to drive a computer 40 and a control 60. Control 60 is a synchronizing system designed so that the RF power source and the time-domain system are not functioning at the same time. Control 60 may be selectively designed so that instead of shutting off the RF generator 30, it may activate a switching mechanism (e.g., circulator) 71 to dump the RF power into a dump 70 through conduit 37. Dump 70 may be any suitable dump mechanism, including, for example, a steam generator, water heater, or the like. Advantageously, steam produced in dump 70 may be used to sweep product 44 from oil shale 20.

Referring now more particularly to FIG. 5, a second preferred embodiment of the probe apparatus of this invention is shown generally at 90 and includes a pair of identical probes 92*a* and 92*b* in a borehole 95. Probes 92*a* and 92*b* are identical in order to minimize measurement errors due to the thermal expansion within each probe and, in particular, the differential expansion between the inner and outer conductors which would otherwise effectively change the extended length of the center conductor. Probe 92*a* is configurated as the reference probe, whereas probe 92*b* is configurated as the measurement probe. Each probe includes ground plane conductors 94*a* and 94*b* with center conductors 96*a* and 96*b* mounted coaxially therein, respectively. Coaxial connectors 98*a* and 98*b* connect the respective probes to their respective coaxial cables (not shown). In order to minimize thermal expansion differentials between the inner and outer elements in each probe, the probes are fabricated from a material having a low coefficient of thermal expansion such as KOVAR. Probe 92*b* has two changing variables: (a) change in the dielectric properties of oil shale 20 and (b) the dimensional changes from differential thermal expansion, both as a function of changes in temperature. Probe 92*a* will experience only this latter effect since it is not in electrical contact with oil shale 20. Therefore, probe 92*a* serves as a reference probe by detecting changes in the physical dimensions as a function of changes in temperature and which are then taken into account in the permittivity calculations as measured by probe 92*b*.

Referring now more particularly to FIG. 6, a third preferred embodiment of the probe apparatus of this invention is shown generally at 100 and includes a probe 102 consisting of a hollow, cylindrical, ground plane conductor 104 having a center conductor 106 coaxially mounted therein. Ground plane conductor 104 is broken away at 105 to reveal the relationship between center conductor 106 and ground plane conductor 104 and in combination therewith a ceramic spacer/plug 114. Ceramic plug 114 prevents material from being forced into the hollow annulus of ground plane conductor 104, which material would tend to give spurious readings for probe 102.

Center conductor 106 is configurated with a penetrating barb 110 and having a plurality of auger-type threads or auger 112 on the exterior surface. Auger 112, in combination with pointed barb 110, permit center conductor 106 to be securely embedded within oil shale 20 (FIGS. 3–5) so as to provide the intimate electrical contact between center conductor 106 and oil shale 20. Probe 102 is electrically interconnected with a coaxial cable (not shown) by a coaxial interconnect 108 which may also be configurated as the appropriate chuck arrangement for rotatably and penetratingly inserting center conductor 106 into oil shale formation 20 (FIGS. 3–5) by means of auger 112.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. An apparatus for measuring in situ the complex permittivity of a substance, the apparatus comprising:
   a hollow ground plane conductor; and
   a center conductor, said center conductor being mounted within the hollow ground plane conductor and said center conductor being adjustable relative to the hollow ground plane conductor such that the capacitance of the apparatus can be varied, thereby measuring the complex permittivity of varying volumes of the substance.

2. An in situ sample holder apparatus as defined in claim 1 wherein the hollow ground plane conductor is substantially cylindrical in shape.

3. An in situ sample holder apparatus as defined in claim 1 wherein the center conductor extends beyond a terminal end of the hollow ground plane conductor.

4. An in situ sample holder apparatus as defined in claim 1 wherein the center conductor is adjustable in length.

5. An in situ sample holder apparatus as defined in claim 1 wherein the center conductor has a penetrating barb on a terminal end thereof.

6. An in situ sample holder apparatus as defined in claim 5 wherein the center conductor has a plurality of auger-type threads thereon adjacent said terminal end thereof.

7. An in situ sample holder apparatus as defined in claim 6 further comprising means for rotating the center conductor so as to engage said portion of the substance with both the barb and the auger-type threads such that the center conductor can be securely embedded in said portion of the substance.

8. An in situ sample holder apparatus as defined in claim 6 further comprising a coaxial interconnect connected to the hollow ground plane conductor and to the center conductor, said coaxial interconnect being configurated as a chuck so as to facilitate rotation of the apparatus such that the barb and the auger-type threads can engage said portion of the substance so as to securely embed the center conductor in said portion of the substance.

9. An in situ sample holder apparatus as defined in claim 1 further comprising a plug positioned between the hollow ground plane conductor and the center conductor so as to prevent said portion of the substance from being forced between the hollow ground plane conductor and the center conductor.

10. An in situ sample holder apparatus as defined in claim 9 wherein the plug is formed of a ceramic material.

11. An in situ sample holder apparatus as defined in claim 1 wherein the hollow ground plane conductor and the center conductor are formed of a material having a low coefficient of thermal expansion.

12. A probe apparatus for measuring in situ the complex permittivity of a substance, the apparatus comprising:
   a hollow ground plane conductor; and
   a center conductor, said center conductor being coaxially mounted within the hollow ground plane conductor and being embedded in a portion of the substance, and said center conductor being adjustable in length relative to the hollow ground plane conductor such that the capacitance of the apparatus can be varied, thereby measuring the complex permittivity of varying volumes of the substance.

13. A probe apparatus as defined in claim 12 wherein the center conductor extends beyond a terminal end of the hollow ground plane conductor.

14. A probe apparatus as defined in claim 13 wherein the center conductor has a penetrating barb on a terminal end thereof.

15. A probe apparatus as defined in claim 14 wherein the center conductor has a plurality of auger-type threads thereon adjacent said terminal end of the center conductor.

16. A probe apparatus as defined in claim 15 further comprising means for rotating the center conductor so as to engage said portion of the substance with both the barb and the auger-type threads such that the center conductor can be securely embedded in said portion of the substance.

17. A probe apparatus as defined in claim 15 further comprising a coaxial interconnect connected to the hollow ground plane conductor and to the center conductor, said coaxial interconnect being configurated as a chuck so as to facilitate rotation of the apparatus such that the barb and the auger-type threads can engage said portion of the substance so as to securely embed the center conductor in said portion of the substance.

18. A probe apparatus as defined in claim 13 further comprising a plug positioned between the hollow ground plane conductor and the center conductor so as to prevent said portion of the substance from being forced between the hollow ground plane conductor and the center conductor.

19. A probe apparatus as defined in claim 18 wherein the plug is formed of a ceramic material.

20. A probe apparatus as defined in claim 19 wherein the hollow ground plane conductor and the center conductor are formed of KOVAR.

21. An apparatus for measuring in situ the complex permittivity of a substance, the apparatus comprising:

a reference probe, said reference probe comprising a first broad band transmission line which is positioned adjacent a portion of the substance; and a measurement probe, said measurement probe comprising a second broad band transmission line, the second broad band transmission line having at least one conductor which is embedded in said portion of the substance.

22. An apparatus as defined in claim 21 wherein a terminal end of each said first and second broad band transmission lines is configurated as a shunt capacitor.

23. An apparatus as defined in claim 21 wherein said first and second broad band transmission lines each comprise an open-ended coaxial transmission line.

24. An apparatus as defined in claim 23 wherein each said open-ended coaxial transmission line comprises:

a hollow ground plane conductor; and a center conductor, said center conductor being coaxially mounted within the hollow ground plane conductor and said center conductor extending beyond a terminal end of the hollow ground plane conductor.

25. An apparatus as defined in claim 24 wherein the center conductor of each open-ended coaxial transmission line is adjustable in length.

26. An apparatus as defined in claim 21 wherein the reference probe and the measurement probe are substantially identical to one another.

27. An apparatus as defined in claim 21 wherein the reference probe and the measurement probe are each formed of a material having a low coefficient of thermal expansion.

28. A method for measuring the complex permittivity of a substance, the method comprising the steps of:

obtaining a probe apparatus, the probe apparatus comprising:

a hollow ground plane conductor; and a center conductor, said center conductor being mounted within the hollow ground plane conductor;

placing the probe apparatus adjacent a portion of the substance such that the center conductor of the probe apparatus is embedded in said portion of the substance;

generating in situ a very fast rise time voltage step between the hollow ground plane conductor and the center conductor of the probe apparatus; and analyzing a system response to the fast rise time voltage step so as to determine the complex permittivity of said portion of the substance.

29. A method as defined in claim 28 wherein the center conductor of the probe apparatus is adjustable in length and further comprising the step of adjusting the length of said center conductor such that the probe apparatus has an optimal capacitance.

* * * * *